US005307986A

United States Patent [19]

Schuster

[11] Patent Number: 5,307,986

[45] Date of Patent: May 3, 1994

[54] EXPANDABLE WATERTIGHT ARTICLE CARRIER

[75] Inventor: Richard L. Schuster, Monroe, La.

[73] Assignee: Riverwood International Corporation, Atlanta, Ga.

[21] Appl. No.: 28,508

[22] Filed: Mar. 9, 1993

[51] Int. Cl.[5] ..... B65D 5/24

[52] U.S. Cl. ..... 229/186; 229/101

[58] Field of Search ..... 229/101, 186, 243, 244, 229/189

[56] References Cited

U.S. PATENT DOCUMENTS

| | | | |
|---|---|---|---|
| 1,373,365 | 3/1921 | Smouse | 229/189 X |
| 3,324,999 | 6/1967 | Farquhar | 229/243 X |
| 3,355,089 | 11/1967 | Champlin | 229/243 |
| 3,447,735 | 6/1969 | Whitney | 229/244 |
| 3,886,901 | 6/1975 | Zeitter | 229/186 X |
| 4,068,795 | 1/1978 | Forster | 229/186 X |
| 4,328,923 | 5/1982 | Graser . | |
| 4,449,633 | 5/1984 | Johnson et al. | 229/242 X |
| 5,016,813 | 5/1991 | Simons | 229/189 |
| 5,094,359 | 3/1992 | DeMars et al. | 229/186 X |
| 5,170,934 | 12/1992 | Lemoine | 229/101 |

FOREIGN PATENT DOCUMENTS

| | | | |
|---|---|---|---|
| 1079240 | 6/1980 | Canada | 229/244 |

*Primary Examiner*—Allan N. Shoap
*Assistant Examiner*—Christopher J. McDonald

[57] ABSTRACT

An article carrier which permits ice to be added to the carrier after removing the top to cool the contents. The carrier is formed from a paperboard blank having a waterproof interior surface. The end and side panels are connected by gusset panels, the end portions of which are adapted to be in nonadhered face-to-face relationship. When the top panel of the carrier is removed, these portions of the gusset panels are relaxed, allowing the side and end panels to pivot out about their foldable connection to the bottom panel for a limited distance to expand the interior of the carrier while maintaining the carrier in watertight condition.

7 Claims, 3 Drawing Sheets

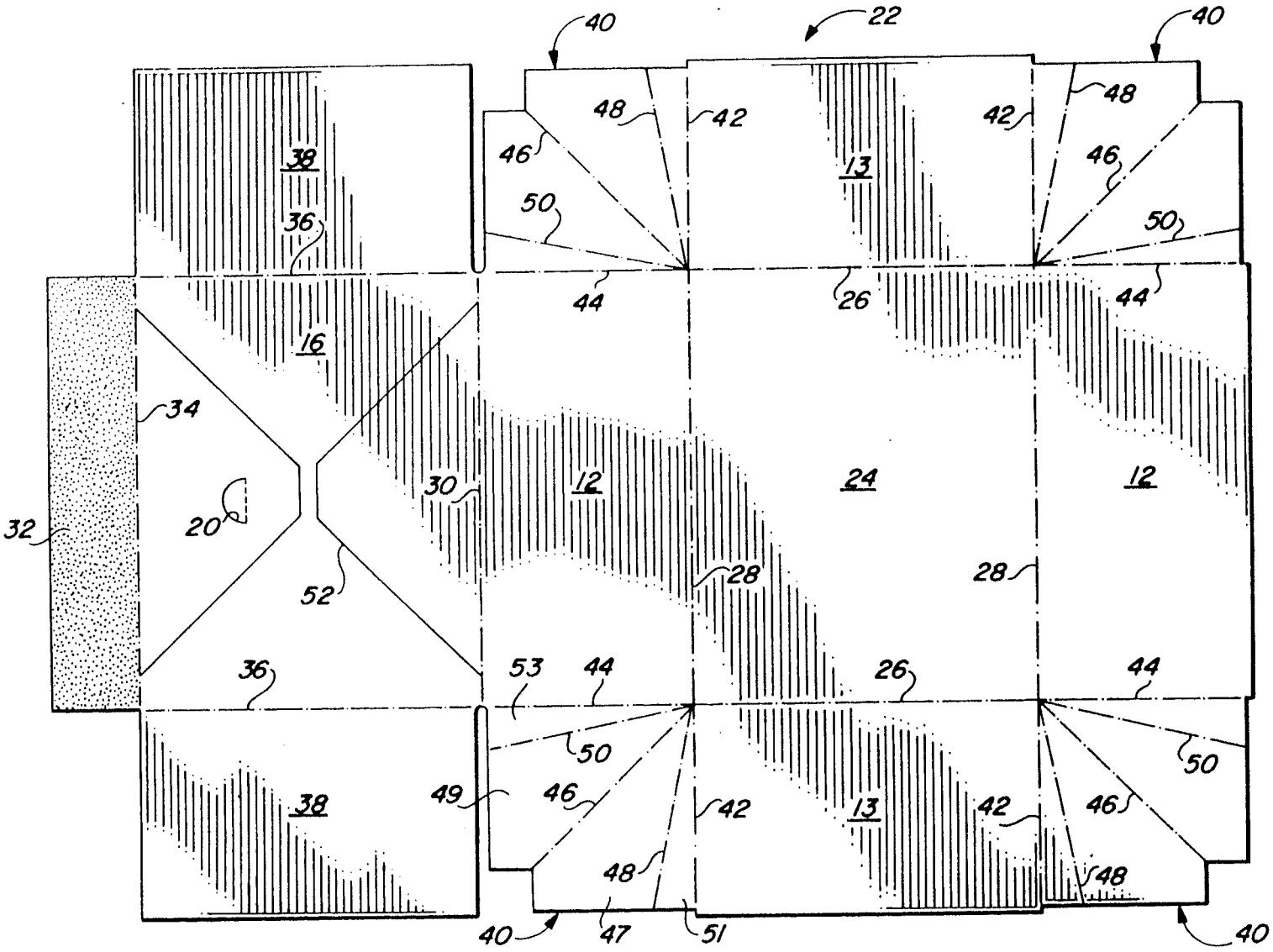
40
48
46
50
44
12
44
50
46
48
40
42
28
42
22
13
26
24
26
13
42
28
42
51
40
48
44
12
44
50
46
48
47
46
50
53
40
30
49
38
36
16
52
38
36
34
20
32

EXPANDABLE WATERTIGHT ARTICLE CARRIER

FIELD OF THE INVENTION

This invention relates to article carriers adapted to carry beverage containers. More particularly, it relates to a carrier the dimensions of which can be increased by a predetermined amount simply by opening the top panel.

BACKGROUND OF THE INVENTION

There are many different designs of carriers used for transporting beverage containers, but none provides space to introduce cooling means directly into the carrier. Instead, it is necessary when picnicking or traveling to put the beverage containers in a cooler, such as an ice chest, in order to chill the contents. Although this is a conventional customary routine, it is nevertheless a cumbersome one, requiring room to be made in a vehicle for the cooler and requiring the heavy cooler to be carried to the picnicking area.

It would be much more convenient to be able to chill the contents of beverage containers by adding ice directly to the container carrier itself. In such a small confined space, a minimal amount of ice would be required to chill and maintain the chilled temperature of the containers. Because the area required for one or more carriers is much less than the room normally taken up by a cooler, the task of transporting cool beverages to their final destination would be greatly simplified.

Although such a method of cooling beverage containers in place would be much preferred over conventional methods, beverage container carriers of current design are not capable of receiving ice while the containers are still in the carrier. Basket-style carriers and open-ended wrap-around style carriers by definition are not suited for this function since they do not provide an enclosed area for receiving both containers and ice. Neither are conventional fully enclosed sleeve-type carriers capable of holding both beverage containers and ice because the normally tight fit of the beverage containers does not leave enough room for ice to be introduced into the carrier. What would be desirable is an enclosed watertight carrier which has the ability to be expanded to a size capable of holding ice in addition to the packaged beverage containers. It is an object of the present invention to provide a carrier which can function in this ideal manner.

BRIEF SUMMARY OF THE INVENTION

An article carrier is provided which has a watertight interior and comprises top and bottom panels connected to side panels and end panels. A gusset panel connects adjacent ends of adjacent side and end panels and includes means which permit limited outward movement of the side and end panels upon opening of the top panel.

Preferably, such means comprises secondary fold lines in the gusset panels between the primary fold line of the gusset panel and the adjacent ends of adjacent side and end panels. The gusset panels are inwardly folded about the primary fold lines, with the portion of each gusset panel between the primary and secondary fold lines being adhered in face-to-face contact, leaving the portions of the gusset panels between the secondary fold lines and the ends of the gusset panels in nonadhered or unconnected substantially face-to-face contact.

Upon opening the top panel, the top panel no longer connects the opposite end panels, thereby permitting the face-to-face nonadhered portions of the gusset panels to separate to the extent made possible by the angle of the secondary fold lines. The separation permits limited outward pivoting movement of the side and end panels which enlarges the interior of the carrier to a degree permitting ice to be introduced into the carrier. Preferably, the top panel includes weakened areas which facilitate opening or removal of the top panel to gain entry to the interior of the carrier.

The carrier preferably is formed from a unitary blank having a waterproof interior surface. In practice, the material of the blank is preferably paperboard and the waterproof surface of the blank comprises a waterproof coating on the paperboard.

These and other features and aspects of the invention, as well as its various benefits, are made more clear in the detailed description of the preferred embodiment which follows.

BRIEF DESCRIPTION OF THE DRAWING

FIG. 2 is a plan view of a production blank for forming the carrier of FIG. 1;

DETAILED DESCRIPTION OF THE PREFERRED EMBODIMENT

Figure 1:
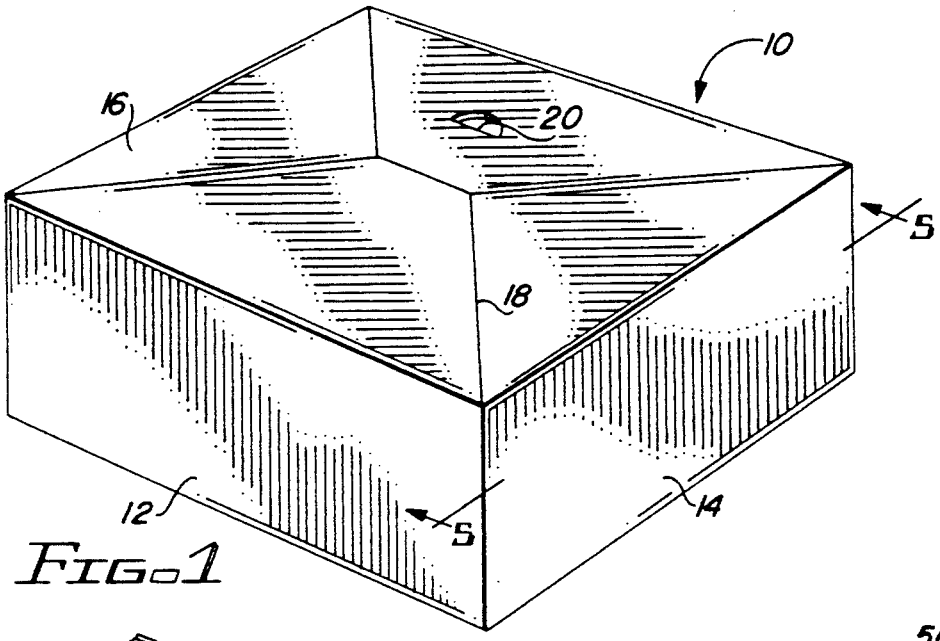
FIG. 1 is a pictorial view of the carrier of the invention.

Referring to FIG. 1, a carrier 10 embodying the invention comprises side panels 12, end panels 14, a top panel 16 and a bottom panel which is hidden in this view. The top panel includes tear strip cuts 18 and a finger hole 20.

A blank for fabricating the carrier is shown in FIG. 2 as comprising a generally rectangular sheet 22, preferably formed of paperboard, which includes a bottom panel section 24 and end panel sections 13, in addition to panel sections 12 and 16 corresponding to the side and top panels of the carrier. The end panel sections 13 are connected by fold lines 26 to end edges of the bottom panel section 24, and the side panel sections 12 are connected by fold lines 28 to the side edges of the bottom panel section 24. The top panel section 16 is connected to the intermediate side panel section 12 by fold line 3 and to a glue strip 32 by fold line 34.

Connected to the end edges of the top panel section 16 by fold lines 36 are end panel flaps 38. In addition, gusset panels 40 are connected to the end panel sections 13 by fold lines 42 and to the side panel sections by fold lines 44. The fold lines 42 are aligned with the fold lines 28, and the fold lines 44 are aligned with the fold lines 26 and 36. Each gusset panel includes a primary diagonally extending fold line 46 which divides the gusset panel into two halves, and two secondary fold lines 48 and 50. Both the primary and secondary fold lines extend from the intersection of the fold lines 26 and 28. The secondary fold line 48 forms an angle with the fold line 42 which is equal to the angle formed by the secondary fold line 50 and the fold line 44. These secondary angles are substantially less than the 45° angle formed by the primary fold line 46 with the fold lines 42 and 44 for a reason explained later. The area between the fold lines 46 and 48 thus forms a major gusset panel segment 47 which is equal in size and shape to the segment 49 formed by the area between the fold lines 46 and 50. The area between the fold lines 48 and 42 forms a minor gusset panel segment 51 which is equal in size and shape to the segment 53 formed by the area between the fold lines 50 and 40.

Figure 6:
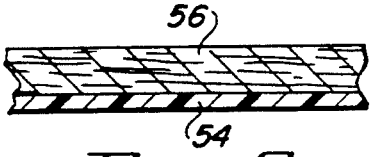
FIG. 6 is an enlarged partial sectional view of the portion of the side panel of the carrier enclosed in the circle 6 of FIG. 5.

The interior surface of the blank, which is the side of the blank shown in FIG. 2, is a waterproof surface. The waterproof nature of the surface cannot be seen in this view, but is shown in FIG. 6, discussed later. The interior surface of the top panel section 16 is provided with tear strip cuts 52 which are offset slightly from the cuts 18 in the exterior surface of the top panel. Both the cuts 18 and 52 extend about half-way through the thickness of the panel so that upon pulling up with some force on the top panel of the carrier through the finger opening 20, the paperboard will tear through its interior structure from the cuts 18 to the cuts 52, separating the top panel into four segments. Tear strips of this design are well known in the industry and are referred to as reverse cuts or "rev cuts".

Figure 3:
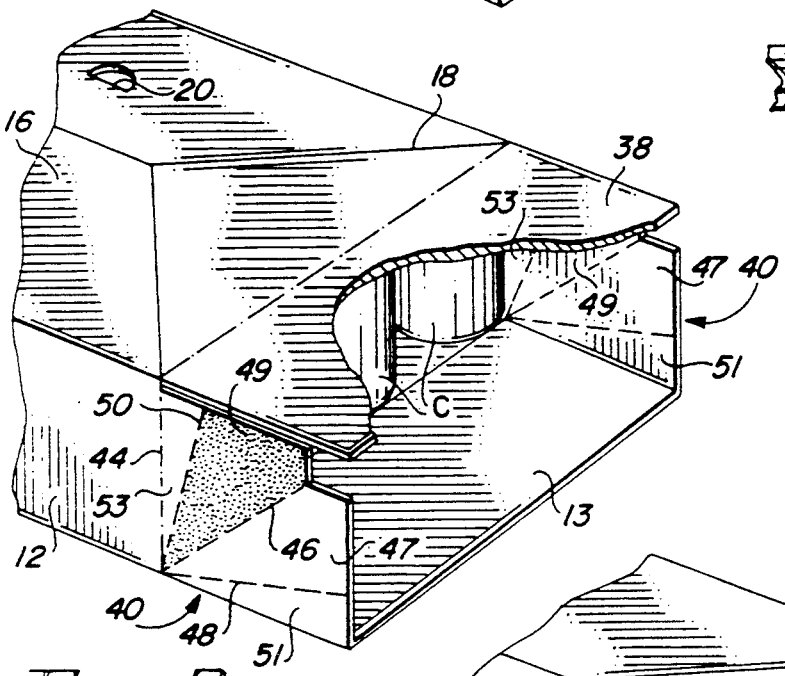
FIG. 3 is a partial pictorial view showing one end of an interim form of the carrier as the end panel is being formed.
Figure 4:
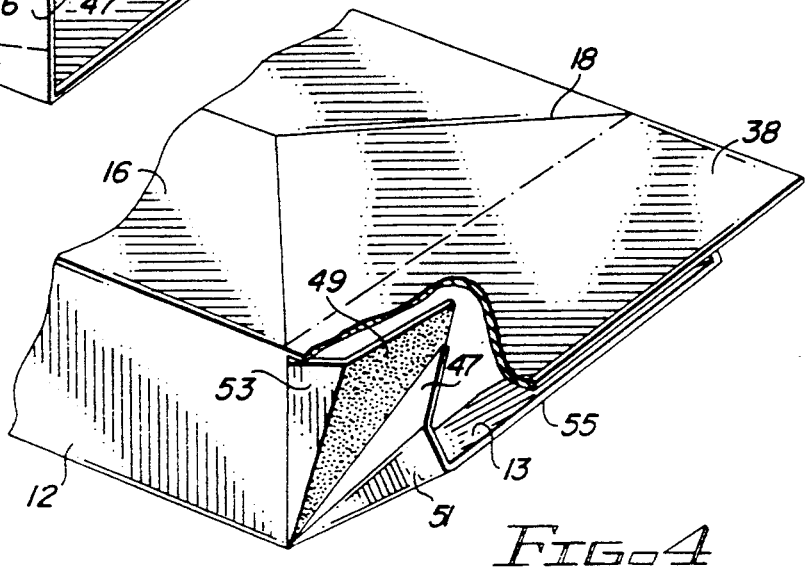
FIG. 4 is a partial pictorial view similar to that of FIG. 3, but showing a later interim form of the carrier.

To form the carrier, glue is applied to the inner surface of the glue flap 32, as indicated by the stippling in FIG. 2, and the blank is folded inwardly along the fold line 30 and along the outermost fold line 28. This brings the glue flap into contact with the outer edge portion of the outer panel section 12 to form an open-ended sleeve. Articles such as beverage cans are loaded through the open ends of the sleeve and the gusset panels are folded into place. One end of the sleeve as it appears after beverage cans C have been loaded is illustrated in FIG. 3, which shows by the stippling that glue has been applied to the exterior surface of the gusset panel segment 49. When the gusset panels are folded inwardly about the fold lines 46, the end panel sections 13 are caused to be raised. This is illustrated in FIG. 4, which shows the sleeve while the gusset panels are in the process of being folded into place. Note that the glue shown in FIG. 3 will cause the folded major gusset panel segments 47 and 49 to be adhered together in face-to-face contact when the folding process is completed. Note also that the minor gusset panel segments 51 and 53 are brought into face-to-face contact by the folding process, but are not adhered together. Upon completion of the gusset panel folding, the end panel flaps 38 are folded down and adhered to the end panel sections 13 by the glue line 55 on the end panel section in FIG. 4.

Figure 5:
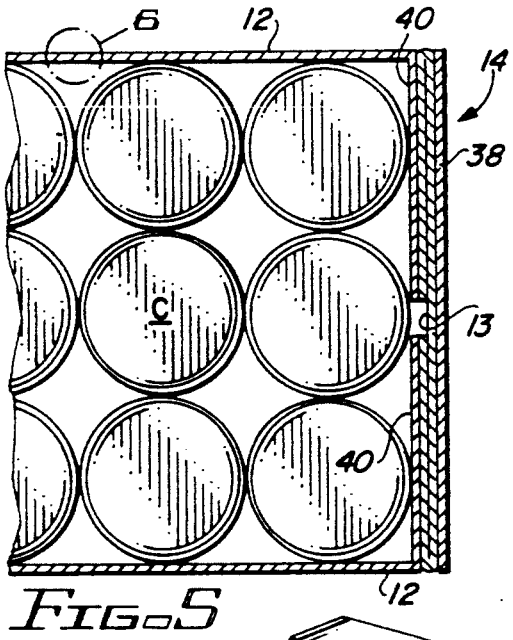
FIG. 5 is a partial longitudinal sectional view taken on line 5—5 of FIG. 1.

As shown in FIG. 5, the cans are securely held in place in the final package between the side panels 12 and the gusset panels 40 of the end panels 14. As previously indicated, the material forming the carrier has an interior waterproof surface. This is illustrated in FIG. 6 as comprising a waterproof coating 54 on the interior surface of the paperboard blank material 56. Any suitable coating material may be employed, such as a layer of high density polyethylene laminated to the paperboard stock.

Figure 8:
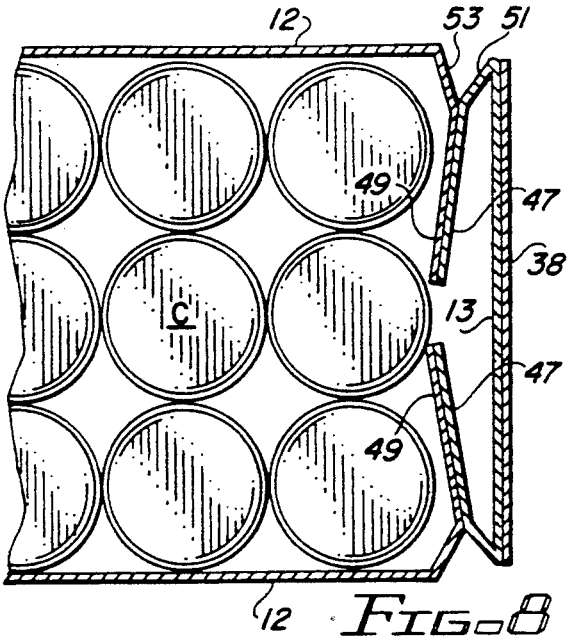
FIG. 8 is a partial longitudinal sectional view similar to the sectional view of FIG. 5, but showing the end panel in the relaxed state of the carrier of FIG. 7.
Figure 7:
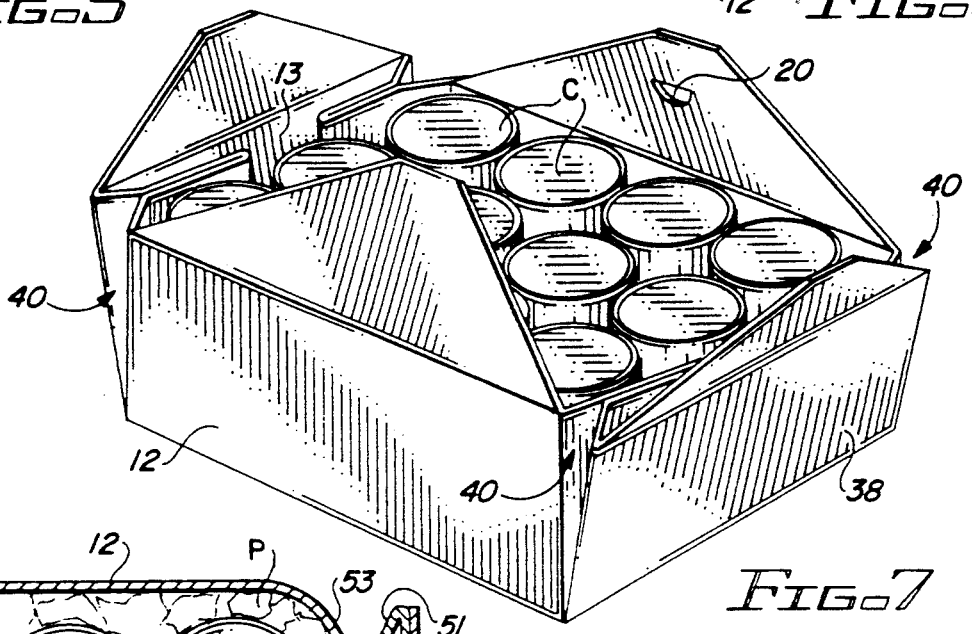
FIG. 7 is a pictorial view of the carrier after the top panel has been opened.

When it is desired to cool the beverage cans, it is merely necessary to pull up on the top panel through the finger hole to rupture the paperboard between the reverse cuts. As shown in FIG. 7, this results in the top panel being separated into four segments each of which is attached to its associated side panel or end panel section. Since the side panels 12 and the end panels 14 are no longer held together at their upper ends by the top panel, there is no longer a tensile force maintaining the minor gusset panel segments 51 and 53 in opposed face-to-face contact. Therefore, the side and end panels are free to pivot outwardly from their foldable attachment to the bottom panel as a result of the opening of the minor gusset panel segments from their closed face-to-face contact. This is shown more clearly in FIG. 8.

Figure 9:
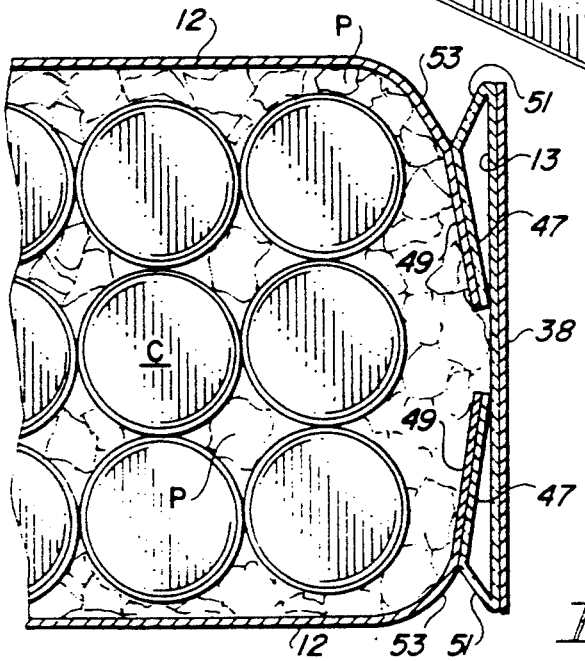
FIG. 9 is a partial longitudinal sectional view similar to that of FIG. 8, but showing the carrier after ice has been added to the carrier through the open top.

At this point ice can be added to the carrier through the open top or the beverage cans can first be removed before adding ice and then pushed down into the layer of ice as desired. FIG. 9 illustrates the carrier with ice particles P surrounding the cans, a situation made possible by the ability of the carrier dimensions to be increased due to the outward pivoting movement of the side and end panels described above. Since the side panels 12 and end panel flaps 13 are foldably connected to the bottom panel and the gusset panels 40 are foldably connected to the ends of the side panels 12 and end panel flaps 13, there are no seams or openings through which water can escape. In addition, the waterproof coating on the interior surface of the carrier prevents water from being absorbed into the paperboard. Thus the expanded carrier is a watertight and waterproof receptacle of greater dimensions than those of the original package, allowing for the extra space taken up by the ice.

It is not desirable for the minor gusset flap segments 51 and 53 to be too large compared to the size of the major gusset panel segments. If that were the case, opening of the top panel would cause the side and end panels to fold out so far that the ice and beverage cans could not be contained in a reasonably compact area. To guard against this situation, it is preferred to keep the angle formed by the fold lines 44 and 50 and the angle formed by the fold lines 42 and 48 no greater than about 30°. This maximum angle results in the angle between the fold lines 46 and the fold lines 48 and 50 being 15°, which produces relatively small major gusset panel segments 47 and 49. In addition, from the standpoint of ensuring that the glue area of gusset segment 49 is large enough to hold the gusset flaps together, the maximum angle of 30° is also important.

It should now be clear that the carrier of the invention provides the unique ability to serve first as a carrier in packaging and transporting articles and then as an ice chest in which the articles can be chilled. The design of the carrier and the blank from which it is formed enable the carrier to have sufficient strength to provide both functions. It should be obvious that although a preferred embodiment of the invention has been described, changes to certain specific details of the preferred embodiment can be made without departing from the spirit and scope of the invention as defined in the appended claims.

What is claimed is:

1. An article carrier having a watertight interior, comprising;

top and bottom panels having side edges and end edges;

side panels connected to the side edges of the top and bottom panels;

end panels connected to the end edges of the top and bottom panels;

a gusset panel connecting adjacent ends of adjacent side and end panels;

a primary fold line in each gusset panel and a secondary fold line between the primary fold line and the adjacent ends of adjacent side and end panels;

the gusset panels being inwardly folded about the primary fold lines, the portion of each gusset panel between the primary and secondary fold lines being adhered in face-to-face contact and the portions of each gusset panel between the secondary fold lines and the ends of the gusset panel being in nonadhered, substantially face-to-face contact, whereby outward movement of the side and end panels permits the nonadhered portions of the gusset panels to move away from each other, thereby permitting limited outward movement of the side and end panels upon opening of the top panel.

2. An article carrier according to claim 1, wherein the top panel is formed from a single panel including weakened areas permitting the top panel to be opened to expose the interior of the carrier.

3. An article carrier according to claim 2, wherein the weakened areas of the top panel divide the top panel into four portions, each portion being connected to an associated end or side panel.

4. An article carrier according to claim 1, wherein the carrier is formed from a unitary blank having a waterproof coating on the interior surface thereof.

5. An article carrier according to claim 3, wherein the weakened areas are partially defined by a cut extending from the interior face of the top panel to a point intermediate the exterior and interior faces, and partially by an adjacent cut extending from the exterior face of the top panel to a point intermediate the exterior and interior faces.

6. An article carrier according to claim 1, wherein the secondary fold lines of a gusset panel form an angle with the adjacent end of the gusset panel not greater than about 30°.

7. An article carrier according to claim 1, wherein the end panels of the carrier include an end panel flap connected to the bottom panel by a fold line, the end panel flap being connected to the gusset panels by fold lines, and a further flap connected by a fold line to the top panel and adhered to the end panel flap.

* * * * *